US006545566B2

(12) United States Patent
Tsukamoto et al.

(10) Patent No.: US 6,545,566 B2
(45) Date of Patent: Apr. 8, 2003

(54) DIELECTRIC FILTER, DIELECTRIC DUPLEXER, AND COMMUNICATION DEVICE

(75) Inventors: Hideki Tsukamoto, Kanazawa (JP); Katsuhito Kuroda, Matto (JP); Jinsei Ishihara, Kanazawa (JP); Hideyuki Kato, Ishikawa-gun (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 09/901,391

(22) Filed: Jul. 9, 2001

(65) Prior Publication Data

US 2002/0003457 A1 Jan. 10, 2002

(30) Foreign Application Priority Data

Jul. 10, 2000 (JP) ..... 2000-208917

(51) Int. Cl.[7] ..... H01P 1/213
(52) U.S. Cl. ..... 333/134; 333/202; 333/206
(58) Field of Search ..... 333/184, 202, 333/206, 207

(56) References Cited

U.S. PATENT DOCUMENTS 6,150,905 A * 11/2000 Nishijima ..... 333/206
6,351,198 B1 * 2/2002 Tsukamoto et al. ..... 333/206
6,362,705 B1 * 3/2002 Kuroda et al. ..... 333/206

FOREIGN PATENT DOCUMENTS

EP 0 731 522 A1 9/1996
EP 0989625 3/2000

OTHER PUBLICATIONS

U.K. Patent Office Search Report dated Apr. 7, 2002.

CTS Part No. 140 (Feb. 12, 1999).

* cited by examiner

*Primary Examiner*—Michael Tokar
*Assistant Examiner*—Vibol Tan
(74) *Attorney, Agent, or Firm*—Dickstein, Shapiro, Morin & Oshinksky, LLP.

(57) ABSTRACT

Plural inner conductor formation holes 2*a*, 2*b*, and 2*c* having inner conductors formed on the inner walls thereof are arranged inside of a dielectric block 1, and an outer conductor 3 is formed so as to cover the outer surface of the dielectric block 1. The openings of the respective inner conductor formation holes 2*a* to 2*c* on the open end side have round hole shapes having substantially the same diameters. The cross-sections of a part of the inner conductor formation holes on the short-circuit end side have angular shapes.

16 Claims, 4 Drawing Sheets

DIELECTRIC FILTER, DIELECTRIC DUPLEXER, AND COMMUNICATION DEVICE

BACKGROUND OF THE INVENTION

1. Field of the Invention

The present invention relates to a dielectric filter for use in a high frequency circuit, a dielectric duplexer, and communication device having the same.

2. Description of the Related Art

In conventional dielectric filters, a plurality of through holes are provided in a dielectric body. The outer surfaces of the dielectric body and the inner surfaces of the through holes are plated to form a series of resonator cavities. Each resonator cavity will have an open end and a short-circuit end. In many filters of this type the inner diameters of each through hole vary so that the line impedances of the resonator cavities are different between the open end and the short-circuit end of the resonator cavity.

FIG. 6 shows an example of one such filter 1. In this example, a plurality of through holes 2*a*, 2*b*, and 2*c* are provided in a rectangular parallelepiped dielectric block 3 whose inner and outer surfaces are substantially coated with a conductive material to form a plurality of resonator cavities. To this end, the inner surfaces of the through holes 2*a*, 2*b* and 2*c* are coated with respective inner conductors 4 and an outer conductor 5 is formed so as to cover substantially the entire outer surface of the dielectric block. The outer conductor 5 is directly coupled to the inner conductor 4 at the end 6 of dielectric block 3 to form short-circuit ends of the resonator cavities. Unplated areas or gaps g are formed in the through holes 2*a*, 2*b* and 2*c* at locations slightly removed from the end 7 of the dielectric block to form open ends of the resonator cavities. Input-output electrodes block 3 and are separated from the outer conductor 5 by unplated portions of the outer surface of the dielectric block. The input-output electrodes are used to couple input and output signals into the adjacent resonators 2*a*, 2*b*.

To adjust the coupling between adjacent resonators and the resonant frequencies of the respective resonators, a step is formed in the resonator cavities so that each resonator cavity is divided into an open end portion and the short-circuit end portion having different diameters.

When dielectric blocks used for these filters are molded, different molds are required for different filters due to the fact that the diameters of the through holes vary from filter to filter.

Moreover, the gaps g are formed by first fully plating the inner walls of the through holes with a conductive material and then using a cutting tool to remove a ring-shaped area of the conductive plating. As a result of variations in the size of the inner diameters on the open end portions of the through holes, control programs for controlling the operation of the cutting tools are required. Additionally, when the positions and widths of the gaps are varied from resonator cavity to resonator cavity, adjustable tools and further control programs are needed.

For these reasons, the production cost of the filter is increased.

One way to reduce production costs is to keep the time which it takes for the tip of the cutting tool to make one revolution when it cuts each of the unplated areas constant. However, because the open end of the through holes have different inner diameters, the cutting rates per unit arc length differ as a function of the inner diameters. Therefore, variations in the amount of the inner conductors and the dielectric block which are cut during this process become large. These variations exert an undesired influence over the characteristics of the filter.

SUMMARY OF THE INVENTION

Accordingly, it is an object of the present invention to provide a dielectric filter and a dielectric duplexer in each of which the above-described problems can be solved, the manufacturing cost can be reduced, and a predetermined characteristic can be obtained, and a communication device having the same.

To achieve the above object, according to the present invention, there is provided a dielectric filter which comprises:

a dielectric block having a plurality of through holes, each of said through holes having an open end section and short-circuit end section, each of said open end sections having the same circular cross-section, at least one of said short-circuit end sections having an angular cross-section;

inner conductors formed on inner walls of said respective through holes, gaps being formed in said inner conductors to define said open end sections of said through holes;

an outer conductor covering most of the outer surface of the dielectric block, said outer conductor being electrically coupled to said inner conductors at one respective end of each of the inner conductor.

In the preferred embodiment, the open end sections of the through holes are cylindrical in shape and are of the same diameter. Therefore, the same type of molds for forming the open end sections of the through holes can be used irrespective of the shapes and sizes of the short-circuit end sections of the through holes. Moreover, the same cutting tool and the same control program for the tool can be used to cut the gaps in the plating located on the inner walls of the open end sections of the through holes. This is true even if adjustments in the size and depth of the gaps are formed to adjust the electrical characteristics of the filter. The foregoing filter can be used in a dielectric duplexer as a transmission filter, a reception filter and/or a transmission-reception filter.

The present invention is also directed towards a duplexer including at least a transmission filter section, a reception filter section and/or a transmission-reception filter section, at least one of said filter sections comprising:

a dielectric block having a plurality of through holes, each of said through holes having an open end section and short-circuit end section, each of said open end sections having a circular cross section, at least one of said short-circuit end sections having an angular cross section;

inner conductors formed on inner walls of the respective through holes, gaps being formed in said inner conductors to define said open end sections of said through holes;

an outer conductor covering most of the outer surface of the dielectric block, said outer conductor being electrically coupled to said inner conductors at one respective end of each of inner conductor.

Moreover, according to the present invention, a communication device provided with the above-described filter or duplexer, e.g., in the filter circuit unit for a transmission-reception signal of a high frequency circuit is formed.

BRIEF DESCRIPTION OF THE DRAWINGS

Other features and advantages of the present invention will become apparent from the following description of the invention which refers to the accompanying drawings.

DETAILED DESCRIPTION OF EMBODIMENTS OF THE INVENTION

Figure 1A:
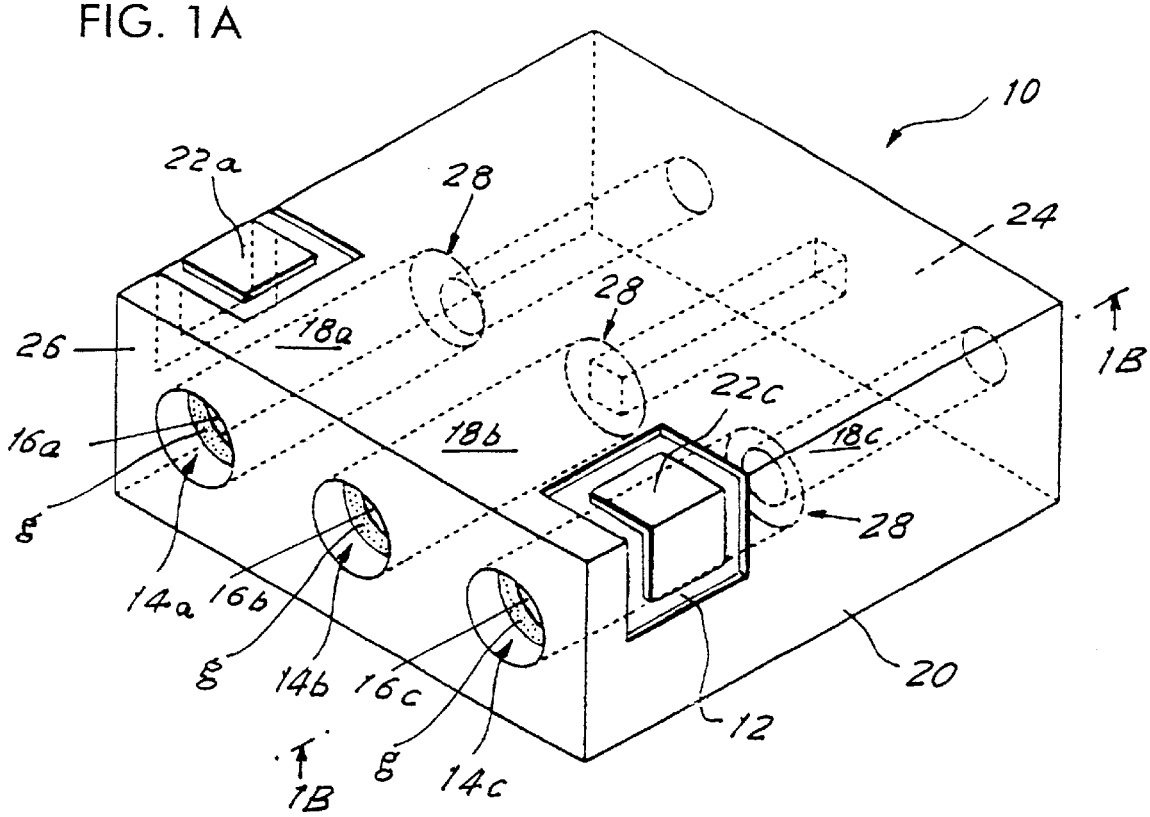
FIG. 1A is a perspective view of a dielectric filter according to a first embodiment of the present invention.

The configuration of a dielectric filter 10 according to a first embodiment of the present invention will be described with reference to FIGS. 1A and 1B.

In this example, the dielectric block 12 has a substantially rectangular parallelepiped shape. A plurality of through holes 14*a*, 14*b* and 14*c* are formed in the dielectric block 12 and have inner conductors 16*a*, 16*b* and 16*c* formed on the inner walls thereof to define respective resonator cavities 18*a*, 18*b* and 18*c*. Substantially all of the outer surfaces (six faces) of the dielectric block 12 are coated with an outer conductor 20, and input-output electrodes 22*a* and 22*c*, insulated from the outer conductor 20, are formed on the outer surface of the dielectric block 12. The outer conductor 20 preferably extends to and contacts the inner conductors 16*a*, 16*b* and 16*c* to form a short-circuit end 24 of the resonator cavities formed by the plated through holes.

The unplated areas or gaps g are formed on the inner walls of the through holes 14*a*, 14*b* and 14*c* in the vicinity of the open end face 26 of the dielectric block 12 and define the open ends of the resonator cavities 18*a*, 18*b* and 18*c*. As best shown in FIG. 1B, the gaps g normally extend into the dielectric block as a result of the cutting process.

A step 28 is preferably formed in the through holes 14*a*, 14*b* and 14*c* at a position approximately half way along the longitudinal length of the through holes to define open end and short-circuit end sections of the through holes. The diameter of the open end section of the through holes is relatively large and the diameter of the short-circuit end section of the through holes is relatively small. In the illustrated embodiment, the open end section of the through holes are cylindrical in shape and are each of the same diameter. On the other hand, the shape of the short-circuit end section of at least one of the through holes is different than the shape of the short-circuit end of at least one other through hole. In the example shown in FIG. 1A, the short-circuit end section of the through hole 14*b* is a rectangular parallelepiped while the shape of the short-circuit end section of the remaining through holes is cylindrical. More generally, in the preferred embodiment, the short-circuit end section of at least one of the through holes has an angular (e.g., rectangular) shape.

The mold (not shown) used to form the dielectric block 12 includes a main cavity having a substantially rectangular parallelepiped shape corresponding to the external shape of the dielectric block and a plurality of pins extending into the cavity. A first set of pins is used to form the open end section of the through holes and a second set of pins are used to form the short-circuit end section of the through holes. The distal ends of respective pairs of pins contact each other to define a single through hole. Because shapes and/or sizes of the short-circuit end sections of at least one of the through holes vary, it is possible to vary the filter characteristics while at the same time forming the open end section of the through holes as cylindrical holes of substantially the same diameter. As a result, the same pins can be used to form open end sections of the through holes for different filters. Only the pins for the closed end sections of the through holes must be changed. Moreover, the cutting tools for forming the gaps g and the control program for controlling the cutting machine to revolve the tips of the tools a single revolution in a circumferential pattern, may be the same for multiple types of filters having different filter characteristics. Moreover, when the characteristics of the filter are adjusted by controlling the positions and widths of the gaps g, one set of adjusting tools corresponding to the inner diameters of the open end portion of the through holes and one set of control programs for adjusting the tools may be used for many different filters having different characteristics.

In accordance with the preferred embodiment of the invention, the resonance frequencies of the respective dielectric resonators and the coupling between adjacent dielectric resonators can be varied by varying the shapes and sizes of the cross-sections of the short-circuit end section of the through holes, the distances between adjacent through holes, etc., without the need to vary the shapes and sizes of the open end section of the through holes. Molds corresponding to the designed values may be used.

Figure 1B:
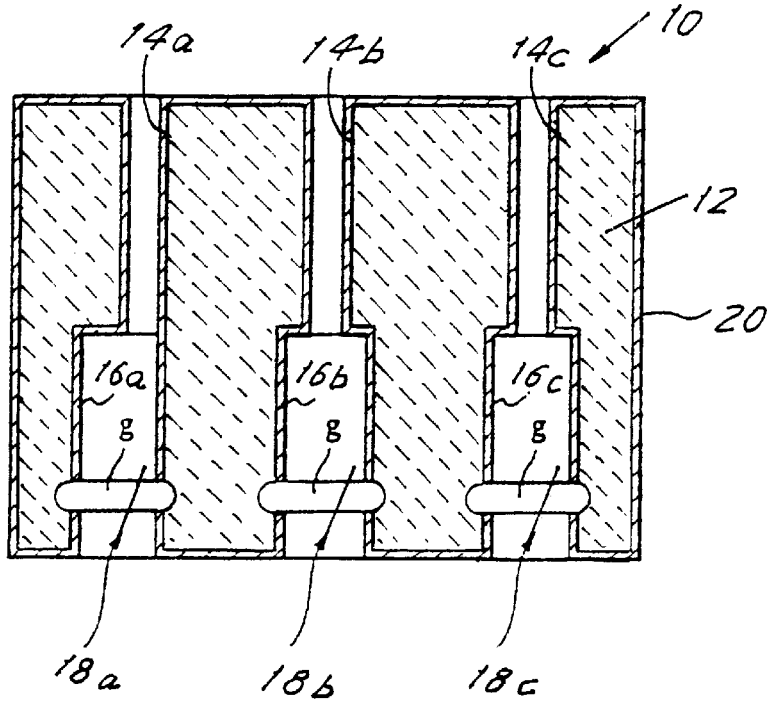
FIG. 1B is a cross-sectional view of the dielectric filter of FIG. 1B taken along lines 1B—1B of FIG. 1A.

In the example shown in FIGS. 1A and 1B, the short-circuit end section of the middle through hole has an angular (rather than circular or elliptical) cross-section. Therefore, the capacitance components generated between the middle resonator cavity and the first, and third stage (the two outer) resonator cavities on the short-circuit end sections can be designed with a high degree of flexibly.

For example, by increasing the width of the cross-section of the short-circuit end section in the thickness direction of the dielectric block 10 (vertically as viewed in FIG. 1A) so that the opposed areas between the adjacent resonator cavities are increased, the static capacitances between the adjacent resonator cavities can be enhanced. Since the faces of the middle resonator cavity which oppose to the outer resonator cavities are flat, the static capacitances between the inner conductors of adjacent resonator cavities can be varied over a wide range.

Figure 2A:
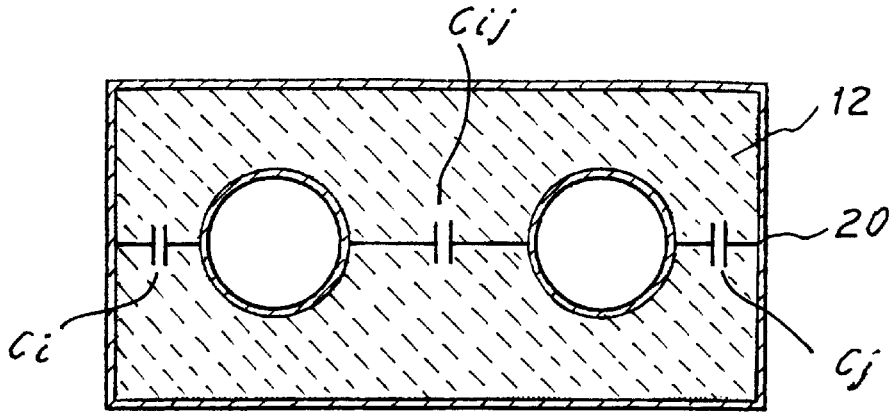
FIGS. 2A, 2B, 2C, and 2D show cross-sectional configurations alternative structures of the dielectric filter.
Figure 2B:
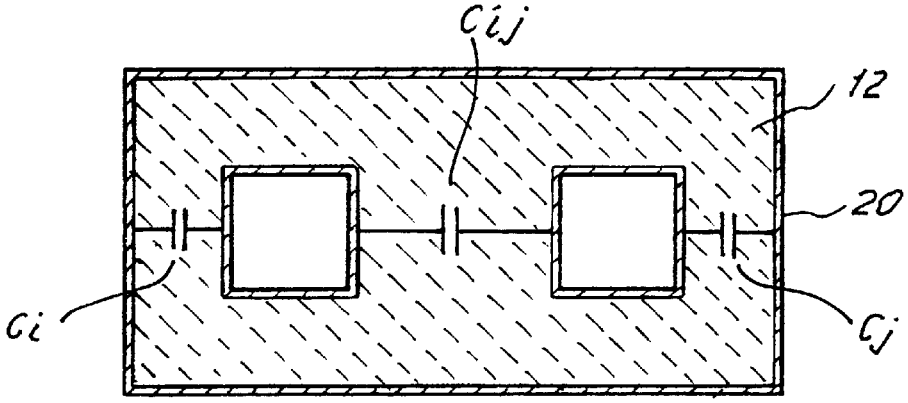
Figure 2C:
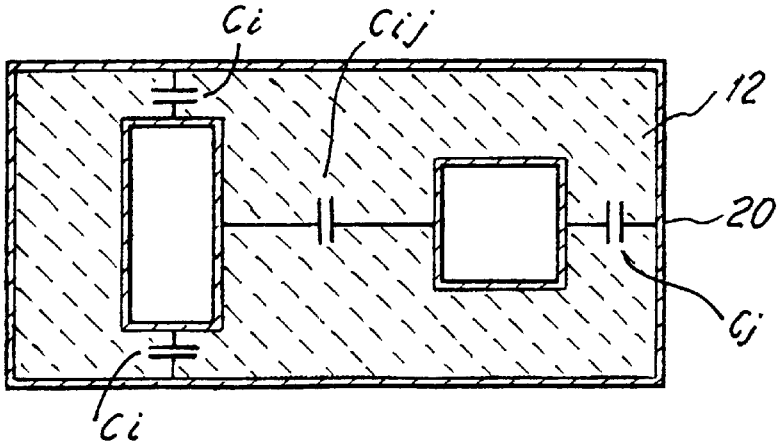
Figure 2D:
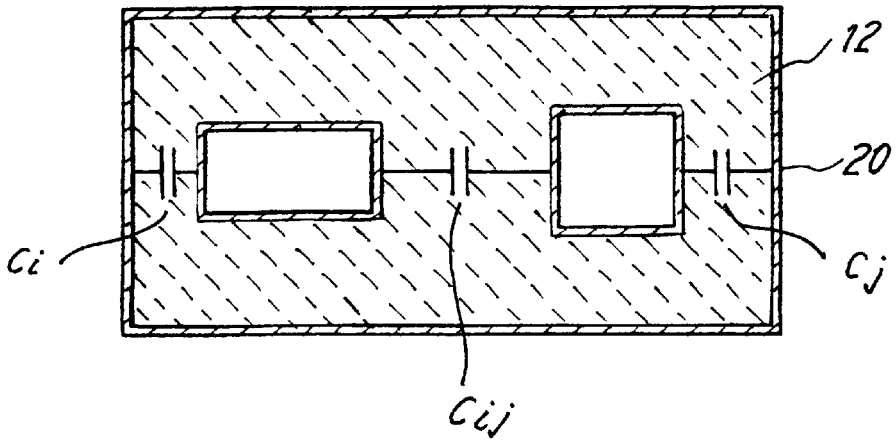

Examples of how this can be done are shown in FIGS. 2A to 2D which are cross-sectional views of devices taken through the short-circuit end section of the resonator cavities of a two stage filter. In FIG. 2A, the cross-sectional shapes of the through holes (and more importantly the inner surface of the inner conductor 16 which define the resonator cavity) are circular. In FIGS. 2B, 2C, and 2D, examples each having an angular (non-circular or parabolic) cross-sectional shapes are shown. By varying the size and shapes of the resonator cavities, the capacitive coupling between adjacent resonator cavities and the outer (ground) electrode can be varied to vary the electrical characteristics of the filter.

In each of the embodiments, a self-capacitance Ci is generated between each inner conductor 16 and the outer conductor 14, and the mutual capacitance Cij is generated between adjacent inner conductors 16. If through holes on the short-circuit end section have a rectangular cross-section as shown in FIG. 2B, the opposed areas between the inner conductors and the outer conductor and that between the inner conductors can be varied substantially independently, in a wide range. That is, by shaping the hole with a rectangular cross-section so that it becomes close to the outer conductor, as shown in FIG. 2C, the self-capacitance Ci on the short-circuit end can be increased, so that the resonance frequency can be enhanced. By shaping the holes having an angular cross-section so that they become close to the adjacent inner conductors 16, as shown in FIG. 2D, the mutual capacitances Cij on the short-circuit end section can be increased, so that the inductive coupling can be enhanced. That is, the inductive coupling between the resonator cavities can be enhanced or the capacitive coupling can be reduced.

As described above, since the short-circuit end section of the through holes has an angular cross-section, the design flexibilities for the mutual capacitance Cij and the self-capacitances Ci and Cj are enhanced. Thus, a desired filter characteristic can be easily achieved.

Hereinafter, the configuration of a dielectric duplexer according to an additional embodiment will be described in reference to FIGS. 3 and 4.

Figure 3:
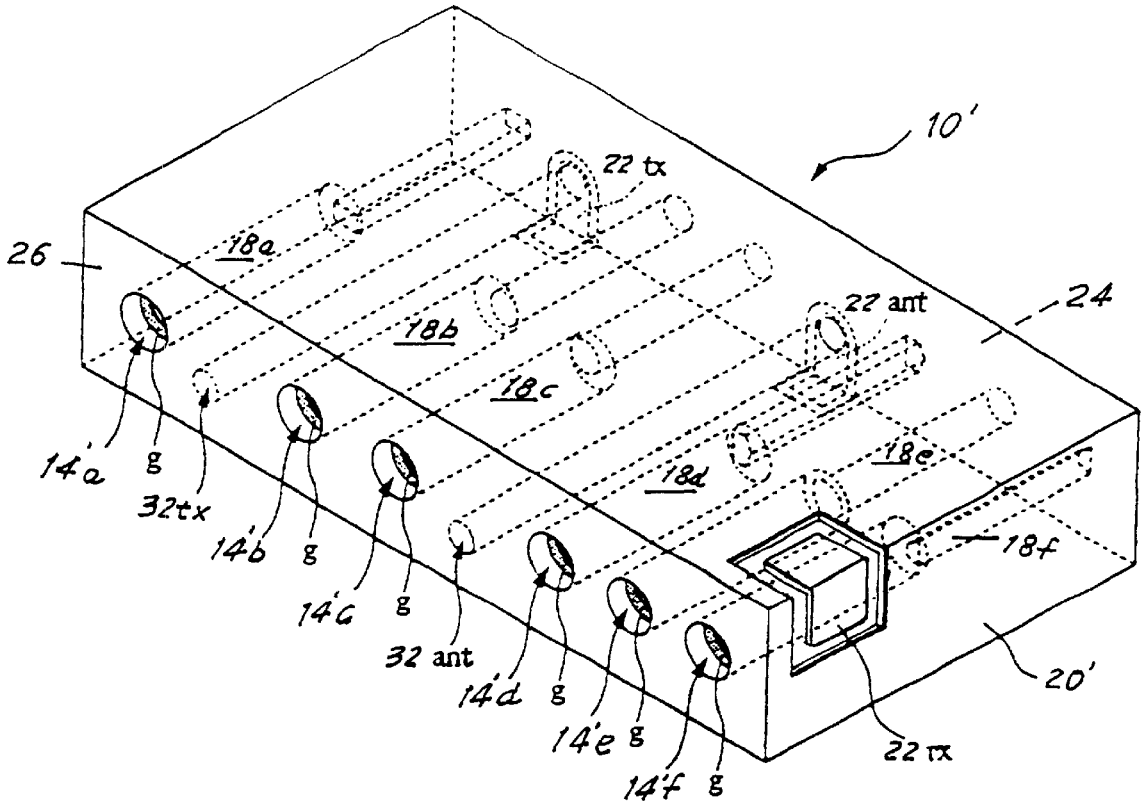
FIG. 3 is a perspective view of a dielectric duplexer according to a further embodiment of the present invention.

FIG. 3 is a perspective view showing the appearance of the dielectric duplexer 10'. As seen in FIG. 3, resonator cavity through holes 14*a* to 14*f* and excitation line through holes 30*tx* and 30*ant* are formed in a rectangular parallelepiped dielectric block 12'. Inner conductors are formed on the inside walls of the through holes 14'*a*. An outer conductor 20', and input-output electrodes 22'*tx*, 22'*ant*, and 22'*rx*, which are insulated from the outer conductor 20, are formed on the six outer faces of the dielectric block 12'. The unplated gaps g are formed in the vicinity of the face 26' of the through holes 14'*a* to 14'*f* defining the open ends of the resonator cavities 20'*a* to 20'*f*. Like the prior embodiments, steps are formed in the through holes to define respective open end and short-circuit end sections of the through holes. Like the prior embodiments, the open end section of the through holes are circular in cross-section and are of the same diameter as one another. The short-circuit end sections of the through holes are preferably smaller in cross-sectional area than the open end section and at least some of them have different cross-sectional shapes than at least some others. The shapes and sizes of the cross-sections of the short-circuit end section of the through holes vary from filter type to filter type to create different filter characteristics. In this example, the cross-sectional shapes of the open end section of the through holes 14'*b*, 14'*c* and 14'*e* are circular. The cross-section of the short-circuit end section of the through hole 14'*c* has a rectangular shape which is elongated in the horizontal direction as viewed in FIG. 3. The short-circuit end section of the through hole 14'*d* has a pentagonal shape in which the faces facing the outer conductor 20' on the upper and lower faces of the dielectric block 12' are close to the outer conductor 20. The short-circuit end section of the through hole 14'*f* is shifted so as to be farther from the short-circuit end section of the adjacent through hole 14'*e* and has a trapezoid cross-sectional shape.

The inner surface of each of the excitation line through holes 30*tx* and 30*ant* is plated to form excitation lines 32*tx* and 32*ant*, respectively.

The input-output electrodes 22'*tx* and 22'*ant* are formed on the short-circuit end face 24' of the dielectric block 12' onto the bottom face of the dielectric block 12', and are electrically connected to one end of the inner conductors formed on the inner walls of the excitation line through holes 30*tx* and 30*ant*. The input-output electrode 22'*rx* is formed near the open end of the inner conductor formed in the through hole 14'*f*, and is capacitively-coupled thereto.

Figure 4:
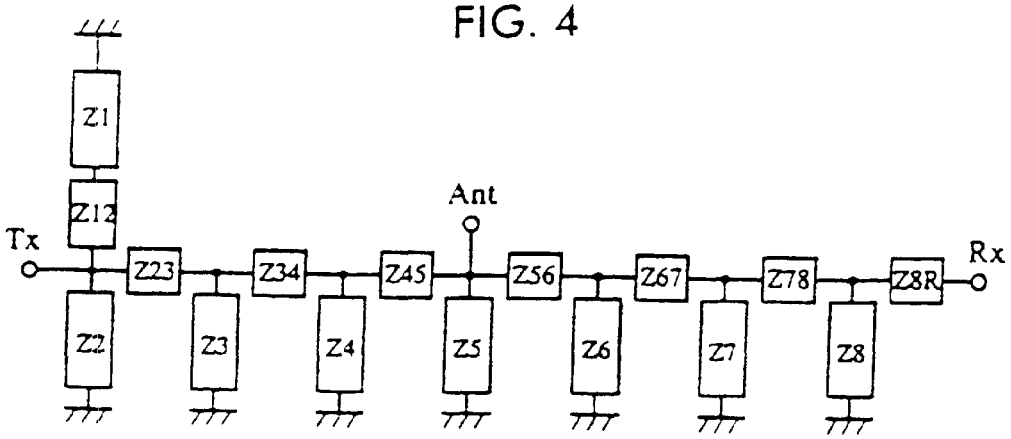
FIG. 4 is an equivalent circuit diagram of the dielectric duplexer.

FIG. 4 is an equivalent circuit diagram of the above-described dielectric duplexer. In the diagram, resonator Z1 comprising the resonator cavity 18*c*, line Z2 comprising the excitation line 32*tx*, resonator Z3 comprising the resonator cavity 18*b*, resonator Z4 comprising the resonator cavity 18*c*, resonator Z5 comprising the excitation line 32*ant*, and resonators Z6, Z7, and Z8 comprising the resonator cavities 18*d*, 18*e* and 26'*f*, respectively. Moreover, a $\pi/2$ phase circuit z12 is formed by interdigital coupling between the lines caused by the excitation line 32*tx* and the resonator cavity 18*a*. Reference numeral Z23 designates an impedance caused by the mutual capacitance between the excitation line hole 32*tx* and the resonator cavity 18*b*. Reference numeral Z34 designates an impedance caused by the mutual capacitance between the resonator cavities 18*b* and 18*c*. Reference numeral Z45 designates an impedance caused by the mutual capacitance between the resonator cavity 18*c* and the excitation line 32*ant*. Similarly, the reference numerals Z56, Z67, and Z78 designate the impedances caused by the mutual capacitances between the excitation line hole 32*ant* and resonator cavity 18*d*, between the resonator cavities 18*d* and 18*e*, and between the resonator cavities 18*e* and 18*f*, respectively. Moreover, reference numeral Z8R denotes the impedance caused by the coupling-capacitance between the resonator cavity 18*f* and the input-output electrode 22'*rx*.

Referring to FIG. 4, since the Z12 functions as a $\pi/2$ phase circuit, the Z1 and the Z2 act as trap resonators. The Z3 and the Z4 function as two-stage resonators which are comb-line coupled to each other. The Z6, the Z7, and the Z8 function as a three-stage resonators which are sequentially comb-line coupled. With this configuration, this dielectric duplexer functions as a dielectric duplexer in which a transmission filter comprising a one-stage trap resonator having an attenuation pole in a transmission band and a two-stage band-pass filter, and a reception filter comprising a three-stage resonator are integrated with each other.

Figure 5:
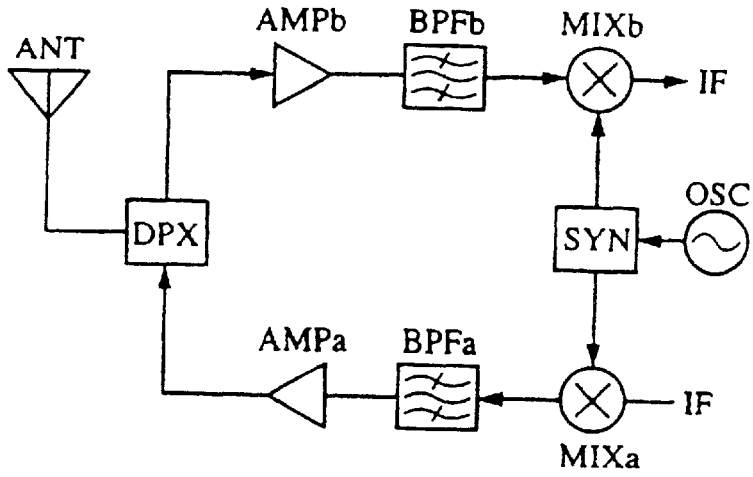
FIG. 5 is a block diagram showing the configuration of a communication device using the dielectric filter of the present invention.
Figure 6:
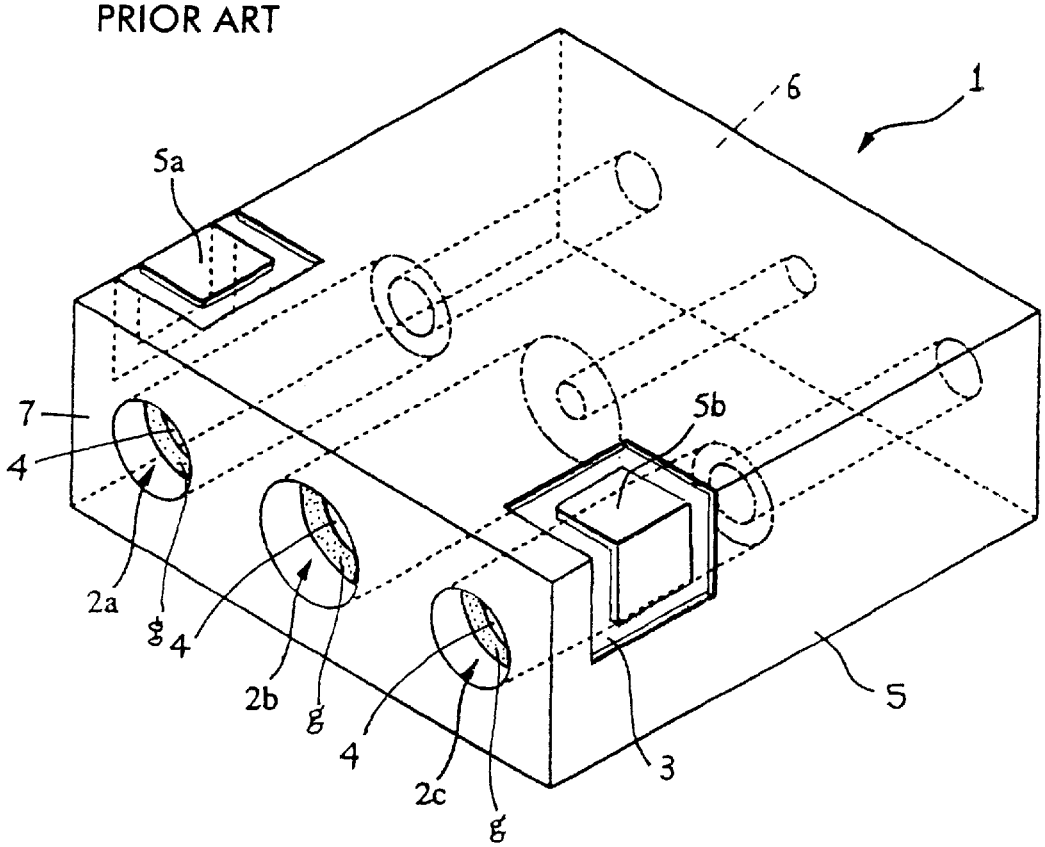
FIG. 6 PRIOR ART
FIG. 6 is a perspective view of a conventional dielectric filter.

An example of the configuration of a communication device using the filters of the present invention is shown in FIG. 5. A transmission-reception antenna ANT, a duplexer DPX, band-pass filters BPFa and BPFb, amplifier circuits AMPa and AMPb, mixers MIXa and MIXb, an oscillator OSC, and a frequency synthesizer SYM are shown.

The MIXa mixes a modulation signal IF and a signal output from the SYN. The BPFa allows only the signal in the transmission frequency band of the mixed output signals from the MIXa to pass. The AMPa power-amplifies the signal and transmits it from the ANT via the DPX. The AMPb amplifies the reception signal received by the ANT and output from the DPX. The BPFb allows only the signal in the reception frequency band of the reception signals output from the AMPb to pass. The MIXb mixes a frequency signal output from the SYN and the reception signal with each other to output an intermediate frequency signal IF.

For the duplexer DPX unit shown in FIG. 5, the duplexer having the configuration shown in FIG. 3 is preferably used. As the band-pass filters BPFa, BPFb, and BPFc, the dielectric filters having the configuration shown in FIG. 1 are preferably used.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A dielectric filter comprising:

a dielectric block having a plurality of through holes, each of said through holes having an open end section and short-circuit end section, each of said open end sections having the same circular cross-section, at least one of said short-circuit end sections having an angular cross-section;

inner conductors formed on inner walls of said respective through holes, gaps being formed in said inner conductors to define said open end sections of said through holes;

an outer conductor covering most of the outer surface of the dielectric block, said outer conductor being electrically coupled to said inner conductors at one respective end of each of the inner conductor.

2. The dielectric filter of claim 1, wherein said angular cross section is a rectangular cross section.

3. The dielectric filter of claim 1, wherein each of said circular sections is of the same diameter.

4. The dielectric filter of claim 1, wherein said open end sections each have a cylindrical shape.

5. The dielectric filter of claim 4, wherein each of said open end sections have the same cross sectional diameter.

6. The dielectric filter of claim 1, wherein at least one of said short-circuit end sections has a different cross section than at least one other of said short-circuit end sections.

7. The dielectric filter of claim 6, wherein said angular cross section is a rectangular cross section.

8. A dielectric duplexer including at least a transmission filter section, a reception filter section and/or a transmission-reception filter section, at least one of said filter sections comprising:

a dielectric block having a plurality of through holes, each of said through holes having an open end section and short-circuit end section, each of said open end sections having a circular cross section, at least one of said short-circuit end sections having an angular cross section;

inner conductors formed on inner walls of the respective through holes, gaps being formed in said inner conductors to define said open end sections of said through holes;

an outer conductor covering most of the outer surface of the dielectric block, said outer conductor being electrically coupled to said inner conductors at one respective end of each of inner conductor.

9. The dielectric duplexer of claim 8, wherein said angular cross section is a rectangular cross section.

10. The dielectric duplexer of claim 8, wherein each of said circular sections is of the same diameter.

11. The dielectric duplexer of claim 8, wherein said open end sections each have a cylindrical shape.

12. The dielectric duplexer of claim 11, wherein each of said open end sections have the same cross sectional diameter.

13. The dielectric duplexer of claim 8, wherein at least one of said short-circuit end sections has a different cross section than at least one other of said short-circuit end sections.

14. The dielectric duplexer of claim 13, wherein said angular cross section is a rectangular cross section.

15. A communication device having a dielectric filter comprising:

a dielectric block having a plurality of through holes, each of said through holes having an open end section and short-circuit end section, each of said open end sections having a circular cross section, at least one of said short-circuit end sections having an angular cross section;

inner conductors formed on inner walls of the respective through holes, gaps being formed in said inner conductors to define said open end sections of said through holes;

an outer conductor covering most of the outer surface of the dielectric block, said outer conductor being electrically coupled to said inner conductors at one respective end of each of inner conductor.

16. A communication device which includes a dielectric duplexer including at least a transmission filter section, a reception filter section and/or a transmission-reception filter section, at least one of said filter sections comprising:

a dielectric block having a plurality of through holes, each of said through holes having an open end section and short-circuit end section, each of said open end sections having a circular cross section, at least one of said short-circuit end sections having an angular cross section;

inner conductors formed on inner walls of the respective through holes, gaps being formed in said inner conductors to define said open end sections of said through holes;

an outer conductor covering most of the outer surface of the dielectric block, said outer conductor being electrically coupled to said inner conductors at one respective end of each of inner conductor.

* * * * *